US007067989B2

(12) United States Patent
Chan et al.

(10) Patent No.: US 7,067,989 B2
(45) Date of Patent: Jun. 27, 2006

(54) MODULARIZED INVERTER CONTROL CIRCUIT

(75) Inventors: Chun-Kong Chan, Hsi Chih (TW); Jeng-Shong Wang, Hsin Chuang (TW)

(73) Assignee: Lien Chang Electronic Enterprise Co., Ltd., Taipei (TW)

( * ) Notice: Subject to any disclaimer, the term of this patent is extended or adjusted under 35 U.S.C. 154(b) by 0 days.

(21) Appl. No.: 10/925,948

(22) Filed: Aug. 26, 2004

(65) Prior Publication Data

US 2006/0043910 A1 Mar. 2, 2006

(51) Int. Cl.
*H05B 37/02* (2006.01)
*G05F 1/00* (2006.01)

(52) U.S. Cl. ..... 315/224; 315/291; 315/307

(58) Field of Classification Search ..... 315/291, 315/224, 294, 299, 324, 307, 32; 361/18; 307/100

See application file for complete search history.

(56) References Cited

U.S. PATENT DOCUMENTS 5,925,990 A * 7/1999 Crouse et al. ..... 315/307
5,930,121 A * 7/1999 Henry ..... 363/16
6,023,132 A * 2/2000 Crouse et al. ..... 315/307
6,072,282 A * 6/2000 Adamson ..... 315/276
6,094,017 A * 7/2000 Adamson ..... 315/307
6,100,647 A * 8/2000 Giannopoulos et al. ..... 315/224

* cited by examiner

*Primary Examiner*—Thuy V. Tran
*Assistant Examiner*—Tung Le
(74) *Attorney, Agent, or Firm*—Rosenberg, Klein & Lee

(57) ABSTRACT

A modularized inverter control circuit makes use of a push-pull type control IC to connect other accessory circuit units, and is packaged and disposed on a printed circuit board to accomplish modularization for driving and control of various inverter circuits. The modularized inverter control circuit comprises a control IC for output of control signals, a lamp current feedback unit connected to the control IC and several lamps for getting working currents of the lamps, a turn-on voltage limit unit connected to the control IC and the lamps for getting working voltages of the lamps, a lamp protection unit connected to the control IC and the lamps and used for open-circuit and short-circuit protection of the lamps, a power source control unit connected to the control IC for providing an electric power, and a reference unit connected to the control IC for providing required reference values for the control IC.

10 Claims, 14 Drawing Sheets

MODULARIZED INVERTER CONTROL CIRCUIT

BACKGROUND OF THE INVENTION

The power supply for a backlight source of a TFT LCD panel makes use of an inverter circuit to accomplish energy conversion and drive a cold cathode fluorescent lamp (CCFL) to be on. Conventional inverter circuits can be divided into half-bridge type, full-bridge type and push-pull type according to different circuit topologies. An inverter circuit is a circuit for converting a DC power into an AC power.

As shown in FIG. 1, a transformer T1 divides the circuit into a front-end circuit at the primary side 101 and a rear-end circuit at the secondary side 102. The front-end circuit at the primary side 101 comprises a DC voltage source Vcc, a first switch Q1, and a second switch Q2. The rear-end circuit at the secondary side 102 comprises at least a capacitor (C1, C2, C3), a load, and at least a diode (D1, D2). A push-pull type control chip 103 is connected between the front-end circuit at the primary side 101 and the rear-end circuit at the secondary side 102. Please also refer to FIG. 2. The push-pull type control chip 103 outputs a first control signal a and a second control signal b for controlling switching actions of the two switches Q1 and Q2 at the primary side 101, respectively. The DC power source Vcc is used to provide energy, and the transformer T1 raises and converts the voltage of the DC power Vcc to the rear-end circuit 102 for driving the load. The output voltage waveform c at the secondary side of the transformer T1 is the voltage waveform at point C. As shown in FIG. 2, the output voltage waveform c at the secondary side is an AC voltage waveform.

In the above description, the push-pull type control chip 103 is produced by Linfinity (Microsemi) Corporation with type of LX1686.

As shown in FIG. 3, a transformer T2 divides the circuit into a front-end circuit at the primary side 201 and a rear-end circuit at the secondary side 202. The front-end circuit at the primary side 201 comprises four electronic switches (P1, P2, N1, and N2), a full-bridge type control chip 203, and a capacitor C1. The rear-end circuit at the secondary side 202 comprises a load. Please also refer to FIG. 4. The full-bridge type control chip 203 outputs four control signals POUT1, POUT2, NOUT1, and NOUT2 for controlling switching actions of the four electronic switches P1, P2, N1, and N2, respectively. The DC power source Vcc is used to provide energy, and the transformer T2 raises and converts the voltage of the DC power Vcc to the rear-end circuit 202 for driving the load. The full-bridge type control chip 203 is produced by Beyond Innovation Technology with the type of BIT3105.

As shown in FIG. 5, a transformer T3 divides the circuit into a front-end circuit at the primary side 301 and a rear-end circuit at the secondary side 302.

The front-end circuit at the primary side 301 comprises a DC voltage source Vcc, two electronic switches (Q1, Q2), a half-bridge type control chip TL494, two capacitors (C1, C2) and an isolation transformer Tr. The rear-end circuit at the secondary side 302 comprises a load. Please also refer to FIG. 6. The half-bridge control chip TL494 outputs control signals D1–D2 via two output terminals D1 and D2. The control signals D1–D2 control switching actions of the two electronic switches Q1 and Q2 via the isolation transformer Tr, respectively. The two electronic switches Q1 and Q2 are n-channel FETs or p-channel FETs. Through switching actions of the two electronic switches Q1 and Q2, electric energy stored in the capacitors C1 and C2 can be transferred to a primary side terminal T31 of the transformer T3 via a coupling capacitor C3 to form an AC power source ac. The voltage of the capacitors C1 and C2 is a half (Vcc/2) of the DC voltage Vcc. The AC power source ac is used to provide energy for the transformer T3, which boosts and converts the ac power source to the secondary side 302 for driving the load.

Please refer to FIG. 7. An inverter circuit 40 and a control chip 42 are connected and disposed on the same printed circuit board. If the used inverter circuit 40 is of the full-bridge type, a full-bridge type control chip 42 needs to be matched for normal operations, if the used inverter circuit is of the half-bridge type, a half-bridge type control chip needs to be matched for normal operations, and if the used inverter circuit is of the push-pull type, a push-pull type control chip needs to be matched for normal operations. Therefore, there is less flexibility and commonality in practical use. Moreover, use of the inverter circuit 40 is usually limited by the control chip 40 to cause malfunction of the inverter circuit 40.

1. Field of the Invention

The present invention relates to a modularized inverter control circuit and, more particularly, to a control circuit making use of a push-pull type control IC to connect other accessory circuit units and packaged and disposed on a printed circuit board to accomplish modularization for driving and control of various inverter circuits.

2. Description of Related Art

SUMMARY OF THE INVENTION

Accordingly, one object of the present invention is to provide a modularized inverter control circuit, which makes use of a push-pull type control IC to connect other accessory circuit units and is packaged and disposed on a printed circuit board to accomplish modularization for driving and control of various inverter circuits.

In the modularized inverter control circuit of the present invention, a control circuit conventionally disposed on the same printed circuit board is separated and disposed on another printed circuit board. The control circuit is used to connect and control an inverter circuit for driving several lamps. The modularized inverter control circuit comprises a control IC used to output two control signals via two output signal pins NOUT1 and NOUT2, a lamp current feedback unit connected to the control IC and at least a lamp and used to get working currents of the lamps and convert them into voltage forms sent to the control IC, a turn-on voltage limit unit connected to the control IC and the lamps and used to get working voltages of the lamps and send them to the control IC, a lamp protection unit connected to the control IC and the lamps and used for open-circuit and short-circuit protection of the lamps, a power source control unit connected to the control IC and used to provide the required electric power for the control IC, and a reference unit connected to the control IC and composed of several resistors and capacitors and used to provide the required reference values for operation of the control IC.

The modularized inverter control circuit of the present invention can thus be flexibly matched with various inverter circuits. The primary advantages are as follows.

1. Standardization and formularization can be accomplished to enhance the quality and reliability of product.

2. The development time of product like the time spent on debug and layout can be shortened.

3. Market requirements can be met
4. Mass production can be accomplished to lower the cost.
5. Inverter circuits of different topologies like externally excited push-pull type, half-bridge type, and full-bridge type can be matched.

The various objects and advantages of the present invention will be more readily understood from the following detailed description when read in conjunction with the appended drawing, in which:

DETAILED DESCRIPTION OF THE PREFERRED EMBODIMENTS

Figure 8:
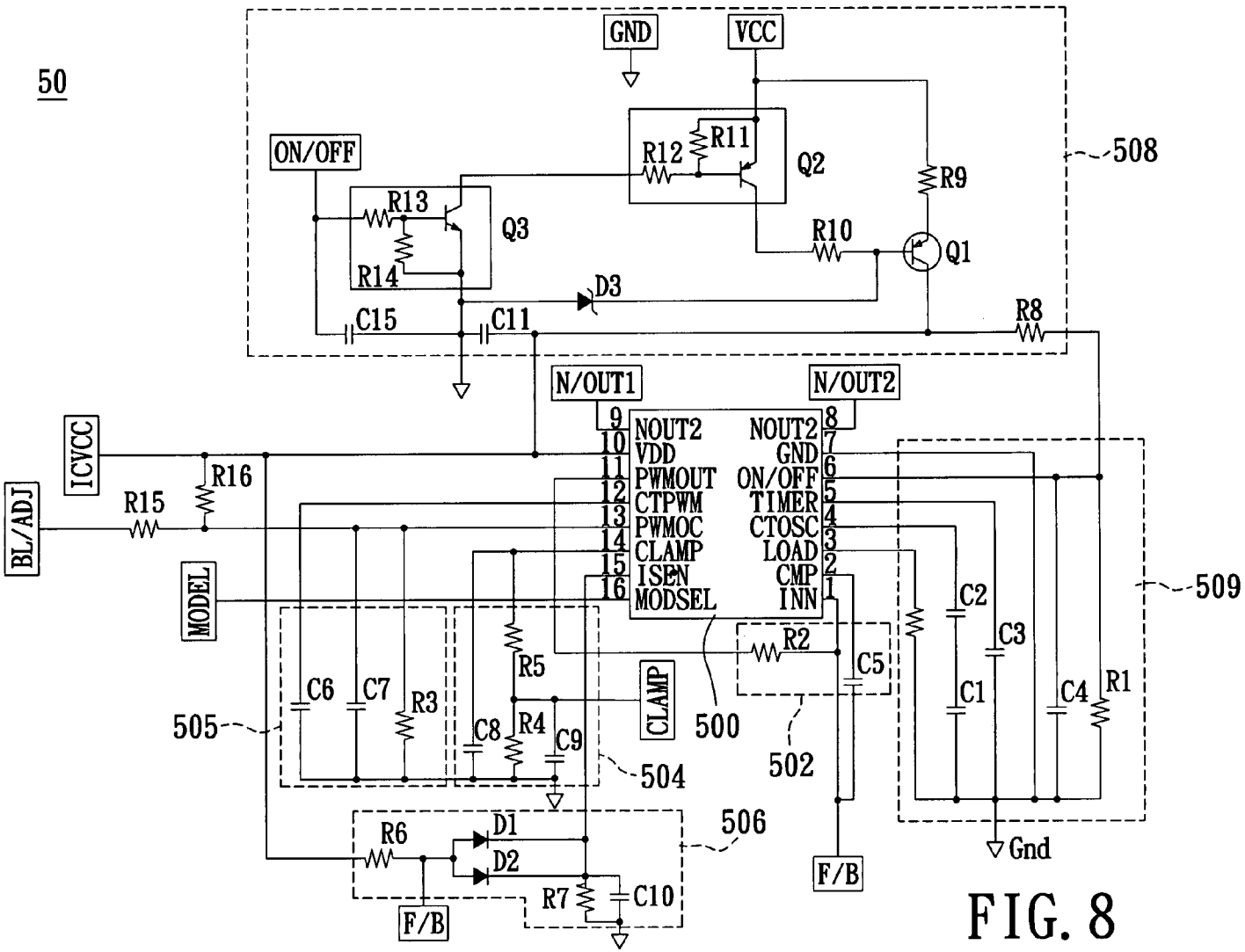
FIG. 8 is a diagram of a modularized inverter control circuit of the present invention.

As shown in FIG. 8, a modularized inverter control circuit 50 of the present invention is packaged and arranged on a printed circuit board (not shown) and used to connect and control an inverter circuit (not shown) for driving of several lamps (not shown). The modularized inverter control circuit 50 comprises a control IC 500 used to output two control signals via two output signal pins NOUT1 and NOUT2, a lamp current feedback unit 502 connected to the control IC 500 and at least the lamps and used to get working currents of the lamps and convert them into voltage forms sent to the control IC 500, a turn-on voltage limit unit 504 connected to the control IC 500 and the lamps and used to get working voltages of the lamps and send them to the control IC 500, a brightness adjustment unit 505 connected to the control IC 500 and the lamps, a lamp protection unit 506 connected to the control IC 500 and the lamps and used for open-circuit and short-circuit protection of the lamps, a power source control unit 508 connected to the control IC 500 and used to provide the required electric power for the control IC 500, and a reference unit 509 connected to the control IC 500 and composed of several capacitors (C1, C2, C3) and a resistor (R1) and used to provide the required reference values for operation of the control IC 500.

Please refer to FIG. 8 again. The control IC 500 is a push-pull type control IC. The lamp current feedback unit 502 is composed of a resistor R2 and a capacitor C5, and gets the working currents of the lamps via a feedback pin (F/B) and converts them into voltage forms sent to the control IC 500. The turn-on voltage limit unit 504 is composed of resistors (R4, R5) and capacitors (C8, C9), and gets the working voltages of the lamps via a voltage acquisition pin (CLAMP) and sends them to the control IC 500. The brightness adjustment unit 505 is composed of a resistor R3 and capacitors (C6, C7), and is used to adjust the brightness of the lamps. The lamp protection unit 506 is composed of resistors (R6, R7), a capacitor C10, and a diode (D1), and gets open-circuit and short-circuit signals of the lamps via a protection pin (PORT), and send them to the control IC 500. The power source control unit 508 is composed of resistors (R8~R14), capacitors (C10, C11), a diode D3, and transistors (Q1, Q2, Q3), and gets the required electric power of the control IC 500 via a power source pin VCC and gets a switch selection signal via a switch pin (ON/OFF).

Figure 1:
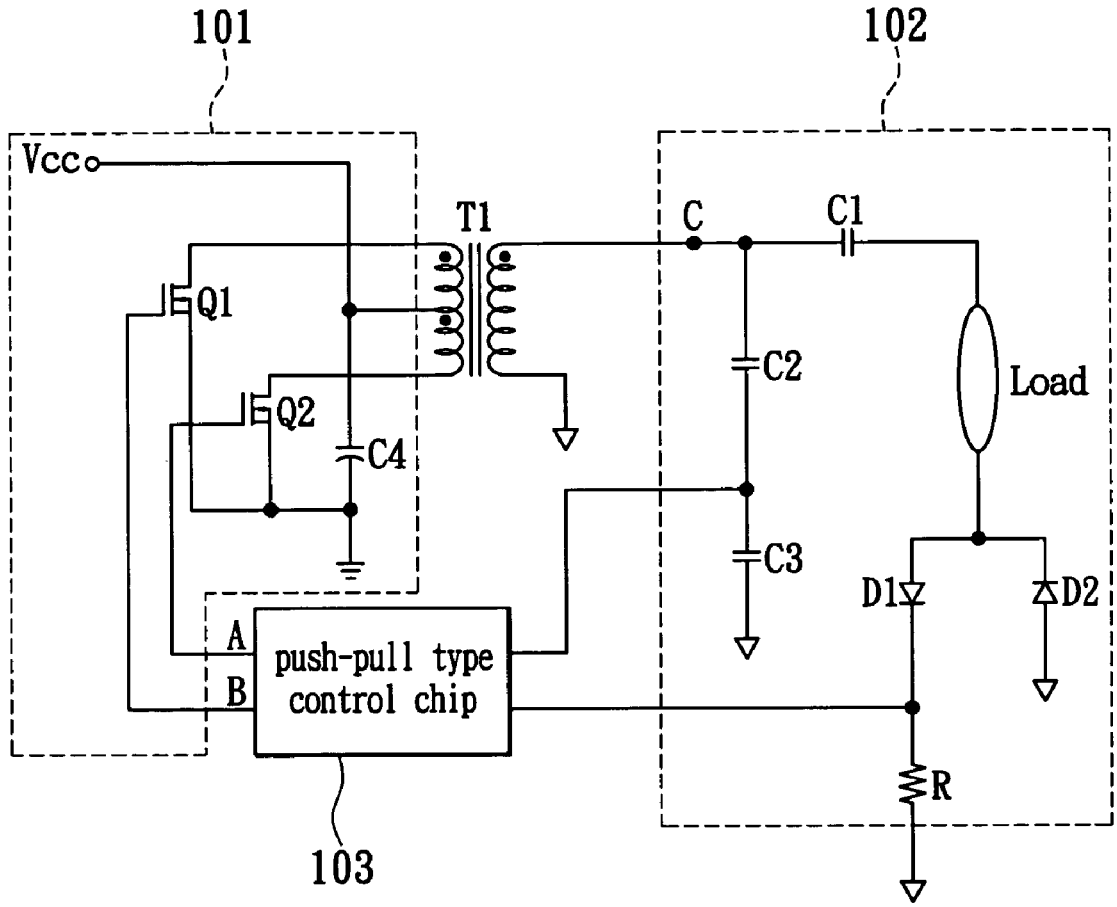
FIG. 1 PRIOR ART
FIG. 1 is a circuit diagram showing how a conventional push-pull type inverter circuit drives a load.
Figure 2:
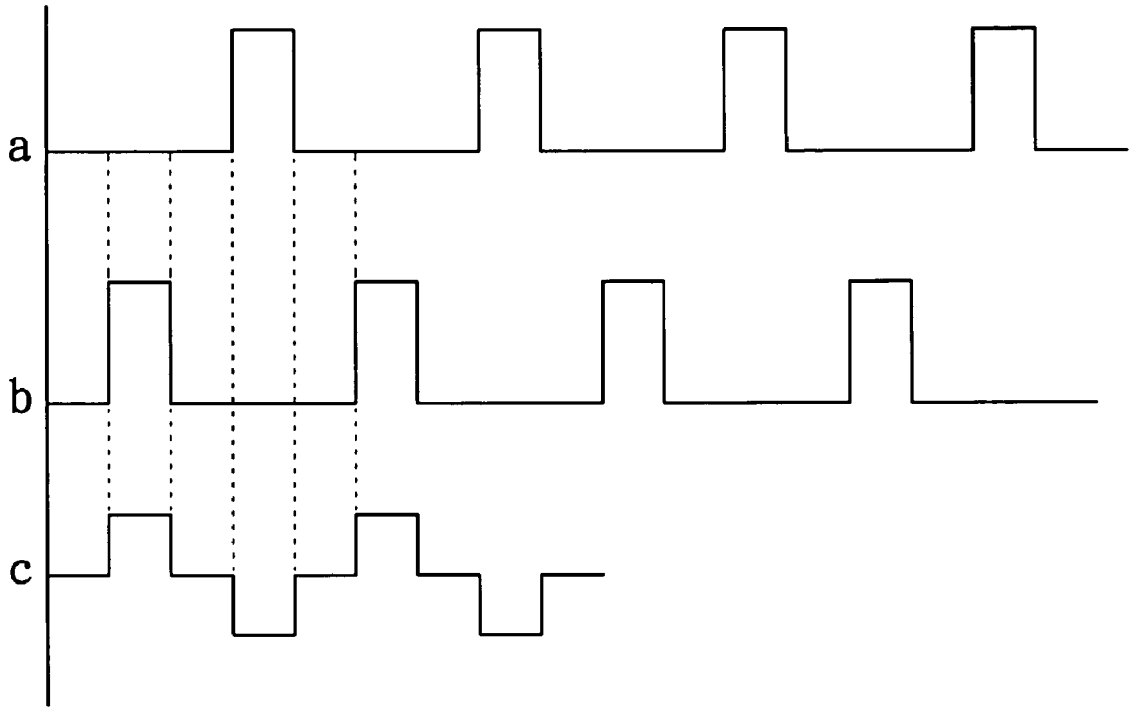
FIG. 2 PRIOR ART
FIG. 2 is a waveform diagram of control signals outputted by a conventional push-pull type control chip and an output voltage at the load end.
Figure 3:
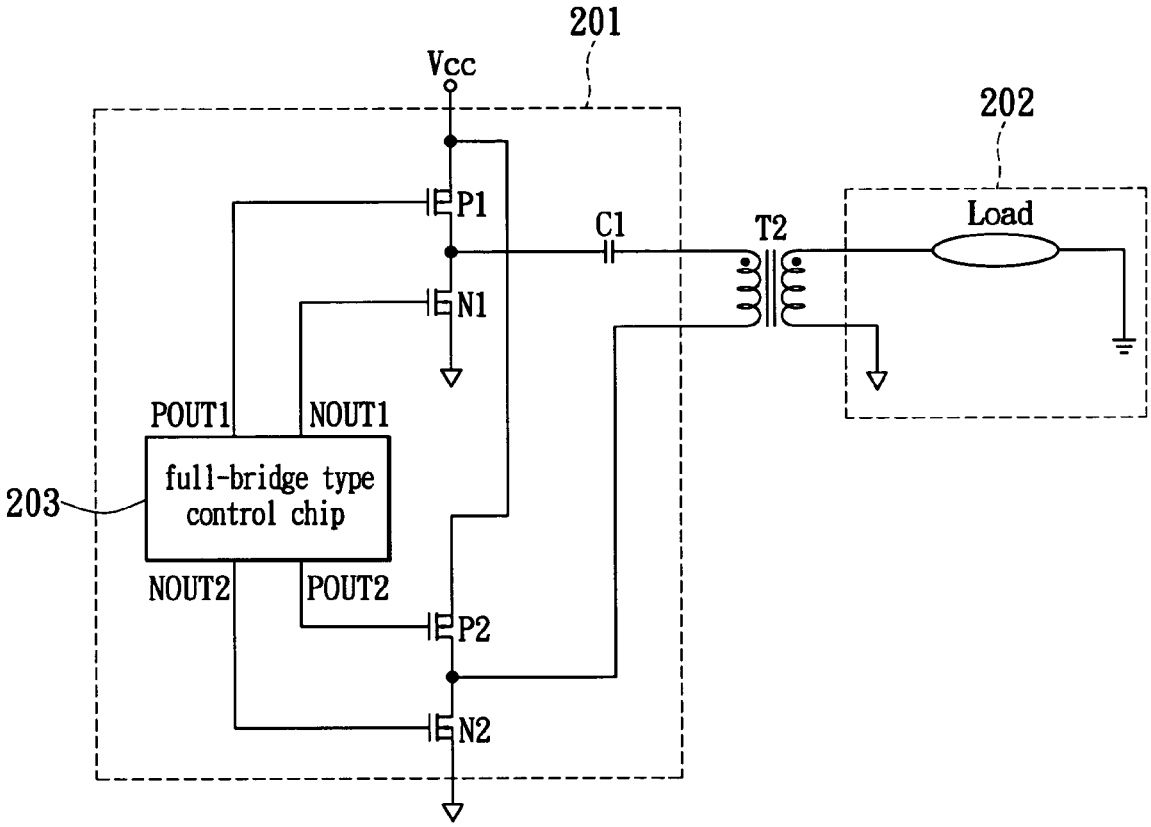
FIG. 3 PRIOR ART
FIG. 3 is a circuit diagram showing how a conventional full-bridge type inverter circuit drives a load.
Figure 4:
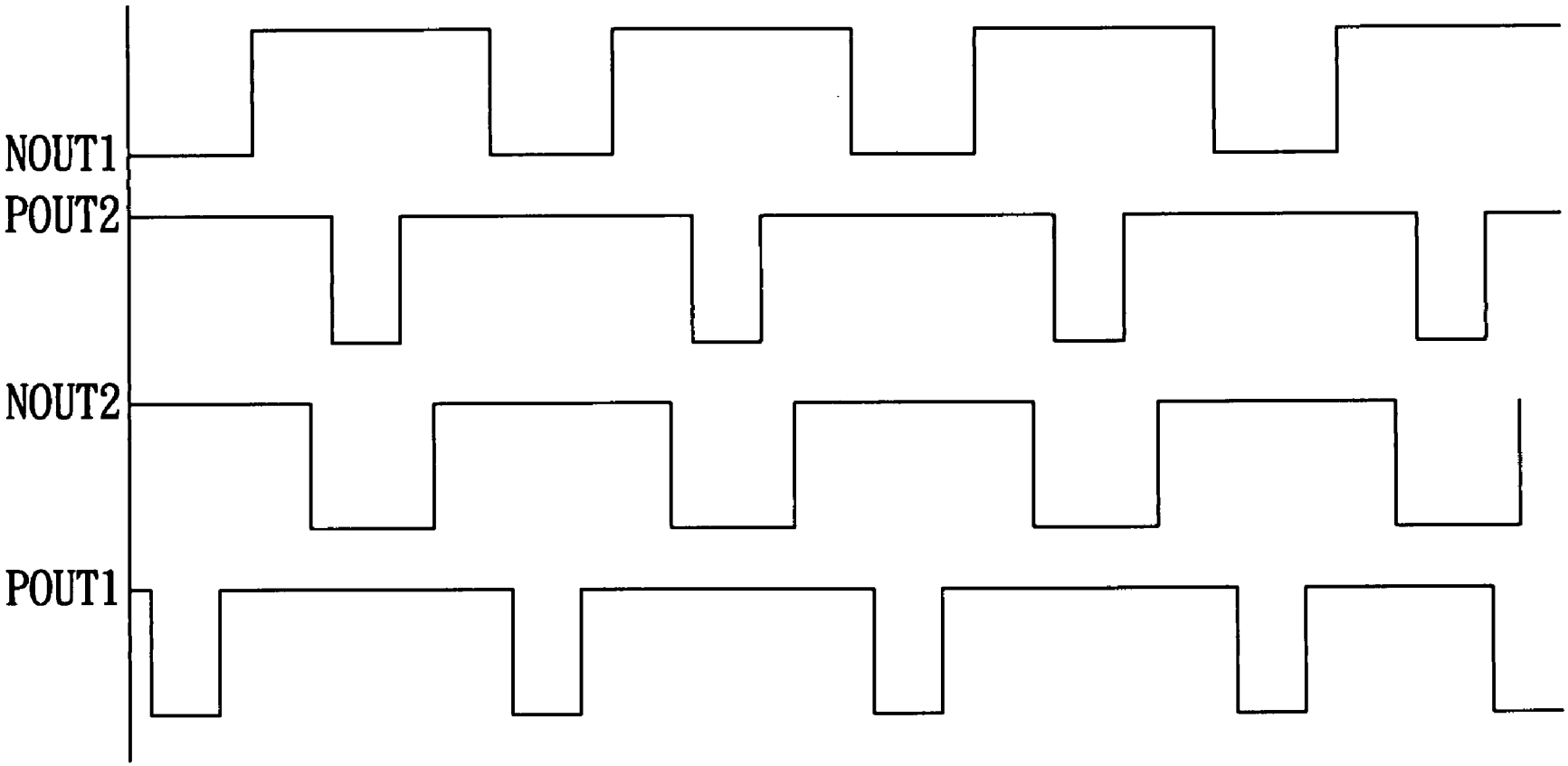
FIG. 4 PRIOR ART
FIG. 4 is a waveform diagram of control signals outputted by a conventional full-bridge type control chip.
Figure 5:
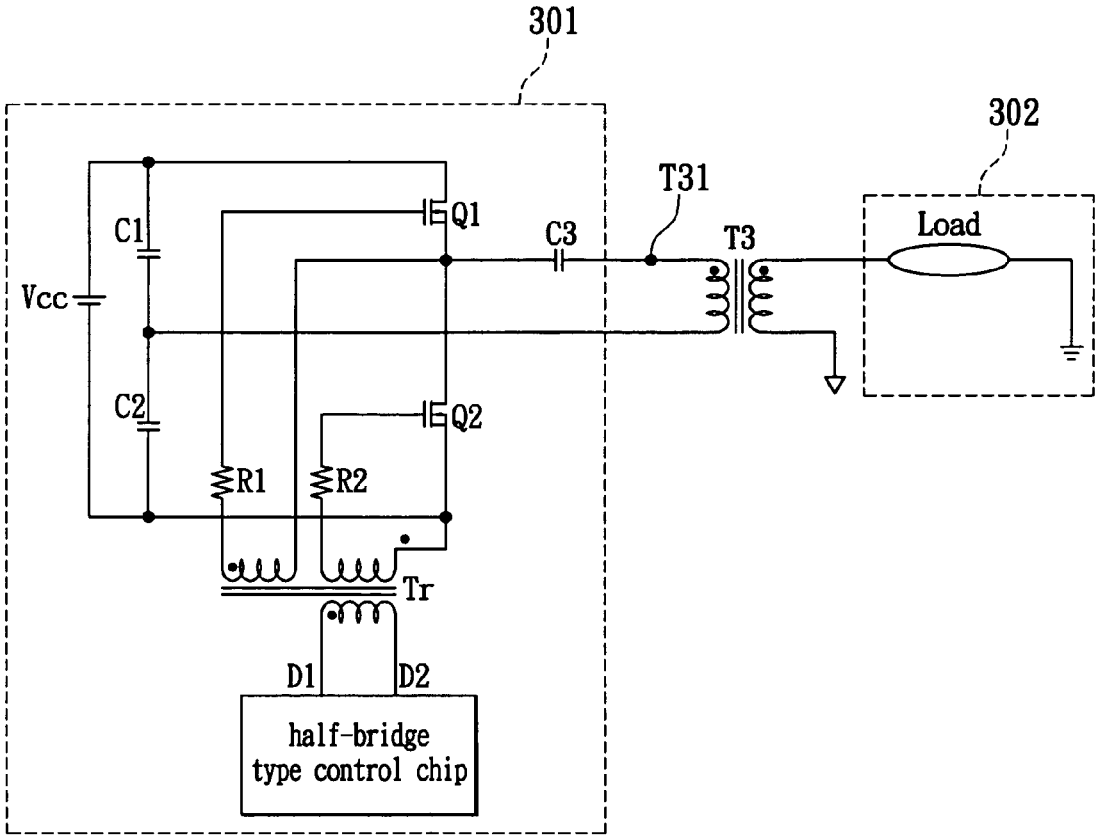
FIG. 5 PRIOR ART
FIG. 5 is a circuit diagram showing how a conventional half-bridge type inverter circuit drives a load.
Figure 6:
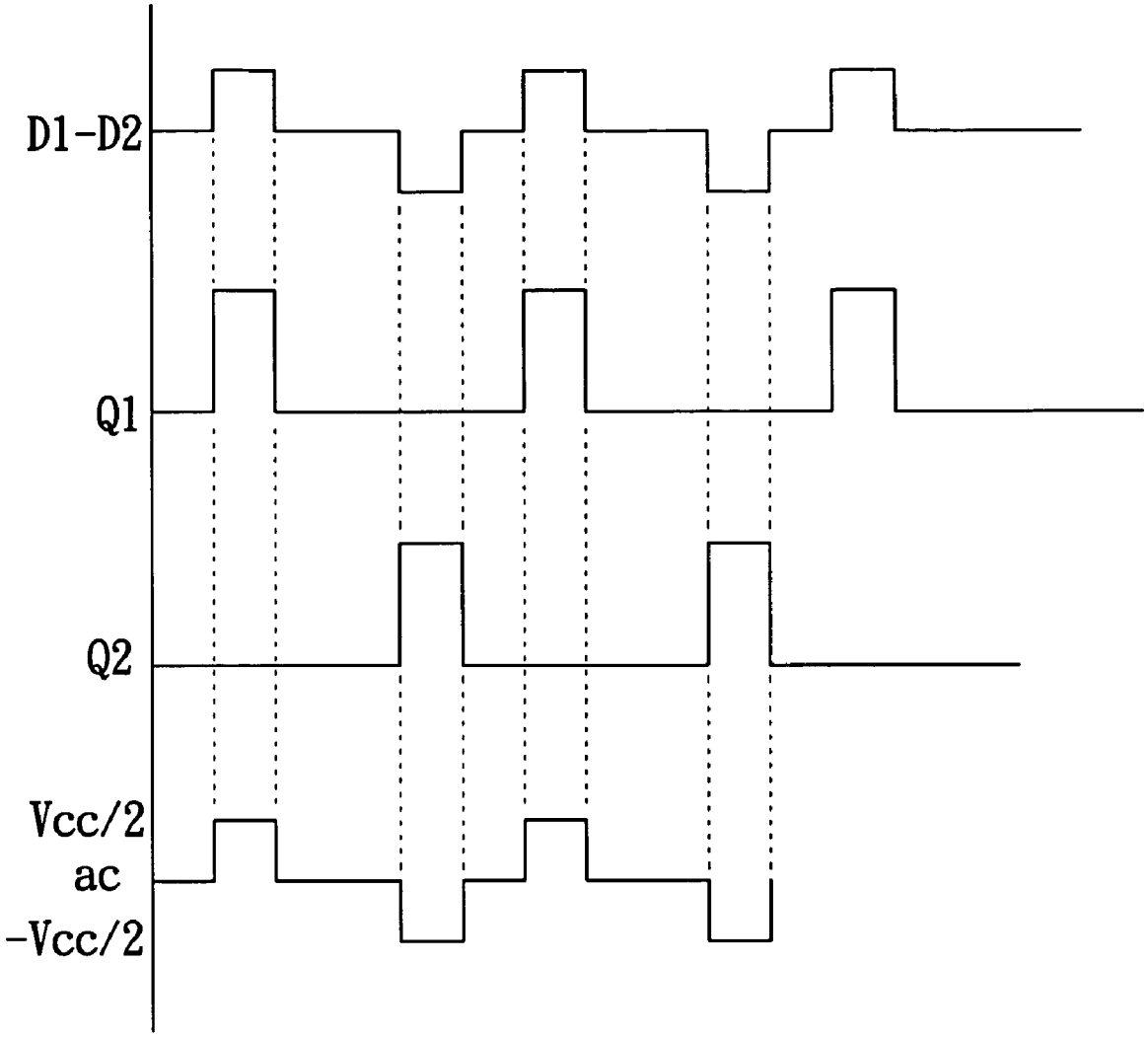
FIG. 6 PRIOR ART
FIG. 6 is a waveform diagram of control signals outputted by a conventional half-bridge type control chip and an AC power source voltage.
Figure 7:
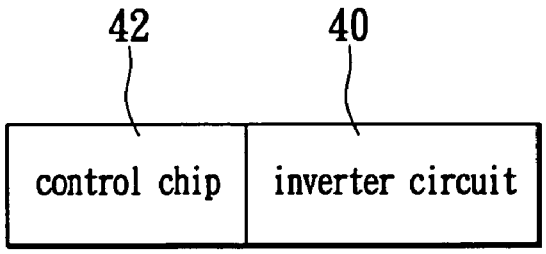
FIG. 7 PRIOR ART
FIG. 7 is a control architecture diagram of a conventional inverter circuit.
Figure 9:
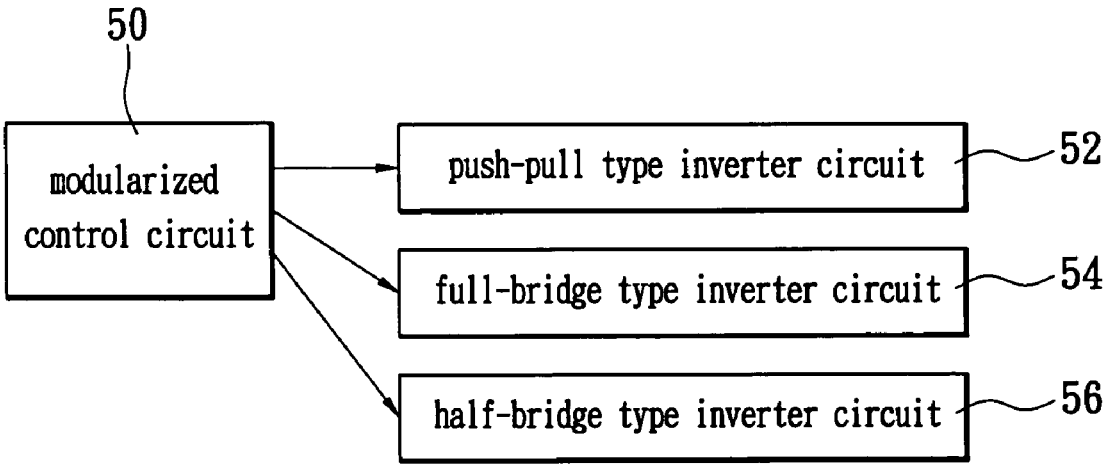
FIG. 9 is a simple architecture diagram showing how the present invention controls various inverter circuits.

FIG. 9 is a simple architecture diagram showing how the present invention controls various inverter circuits. Users can more flexibly connect the modularized inverter control circuit of the present invention to inverter circuits of different topologies like a push-pull type inverter circuit 52, a full-bridge type inverter circuit 54, and a half-bridge type inverter circuit 56 to control these inverter circuits for driving the lamps to be on.

Figure 10:
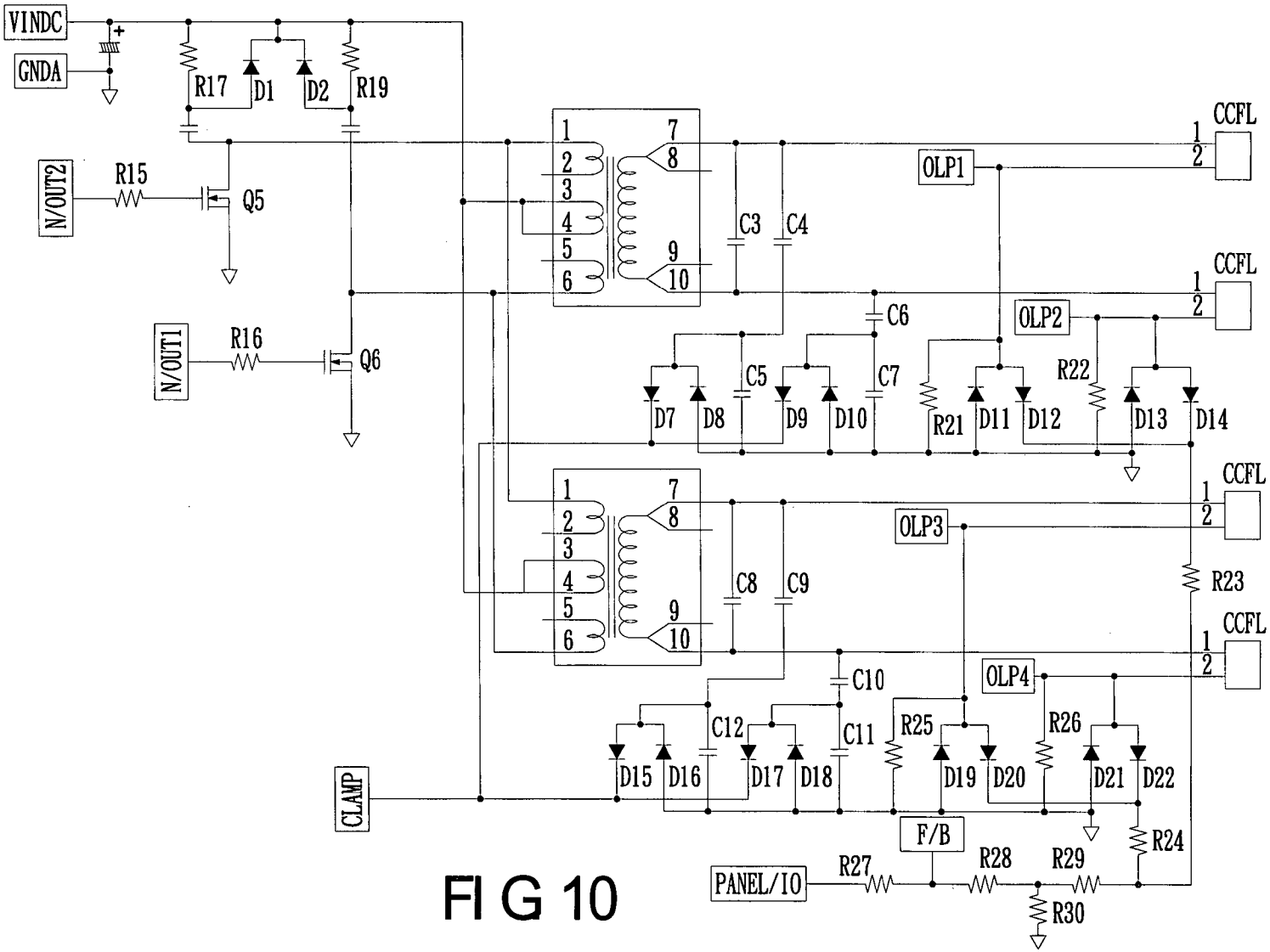
FIG. 10 is a circuit diagram of a push-pull type inverter circuit.

Please refer to FIG. 10 as well as FIG. 8. In FIG. 10, the push-pull type inverter circuit 52 makes use of control terminals of a power switch Q5 and a power switch Q6 connect the two output signal pins (NOUT1, NOUT2) of the control IC 500 in FIG. 8 via a resistor R15 and a resistor R16, respectively, and receives two control signals outputted by the two output signal pins (NOUT1, NOUT2). Moreover, the terminals F/B, CLAMP, and PORT shown in FIG. 10 are correspondingly connected to the feedback pin (F/B), the voltage acquisition pin (CLAMP), and the protection pin (PORT) of the control IC 500.

In the above illustration, the modularized inverter control circuit of the present invention can be connected to the push-pull type inverter circuit 52 and use the two control signals to control switching actions of the power switches Q5 and Q6 of the push-pull type inverter circuit 52 for driving the lamps CCFL to be on.

Figure 11:
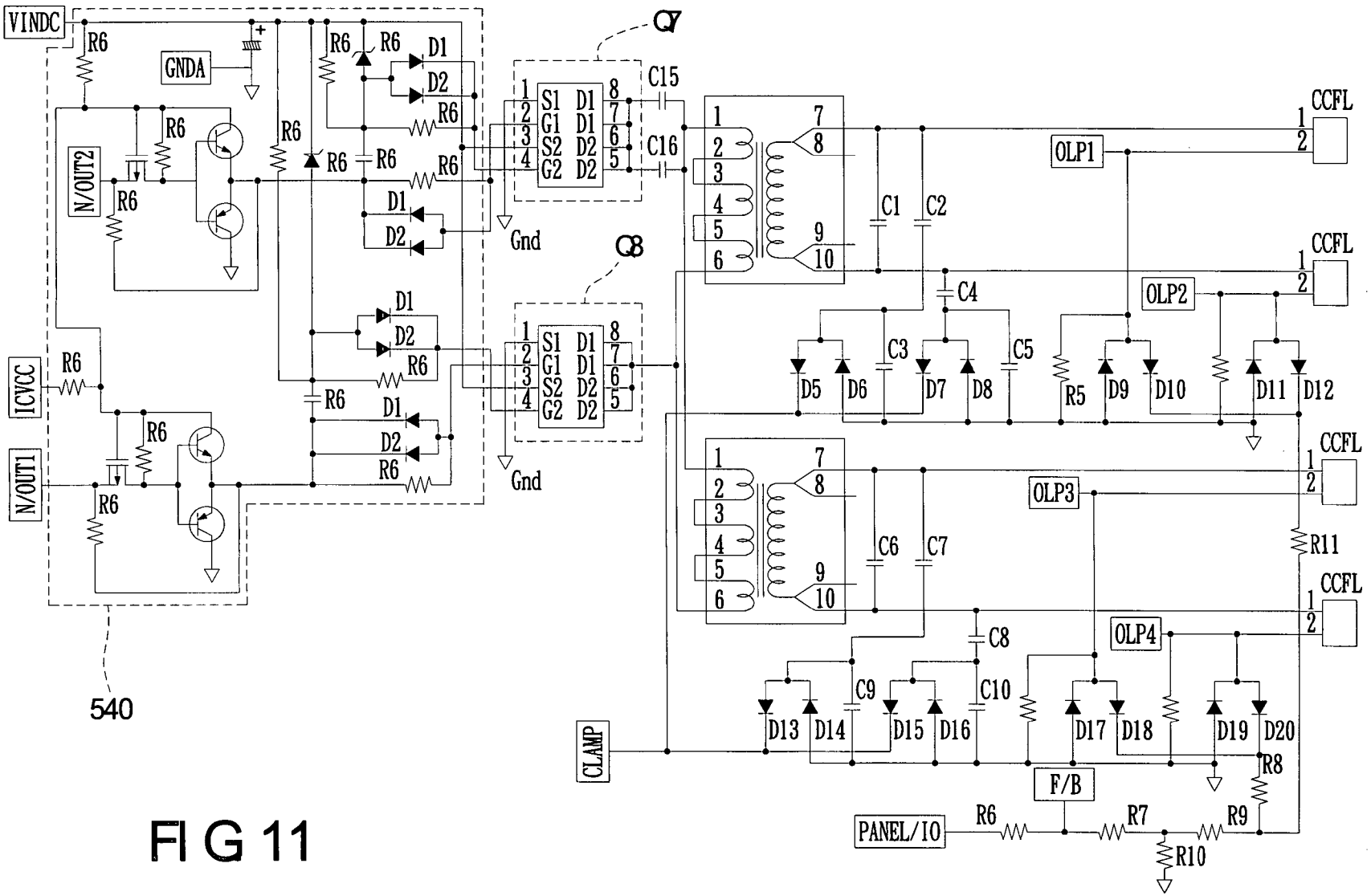
FIG. 11 is a circuit diagram of a full-bridge type inverter circuit.

Please refer to FIG. 11 as well as FIG. 8. In FIG. 11, the full-bridge type inverter circuit 54 is connected to the two output signal pins (NOUT1, NOUT2) of the control IC 500 in FIG. 8 via a conversion circuit 540, and receives two control signals outputted by the two output signal pins (NOUT1, NOUT2). Moreover, the terminals F/B, CLAMP, and PORT shown in FIG. 11 are correspondingly connected to the feedback pin (F/B), the voltage acquisition pin (CLAMP), and the protection pin (PORT) of the control IC 500.

In the above illustration, the modularized inverter control circuit of the present invention can be connected to the full-bridge type inverter circuit 54, send the two control signals to the conversion circuit 540 of the full-bridge type inverter circuit 54, and use the conversion circuit 540 to control switching actions of a power switch set Q7 and a power switch set Q8 for driving the lamps CCFL to be on.

Figure 12:
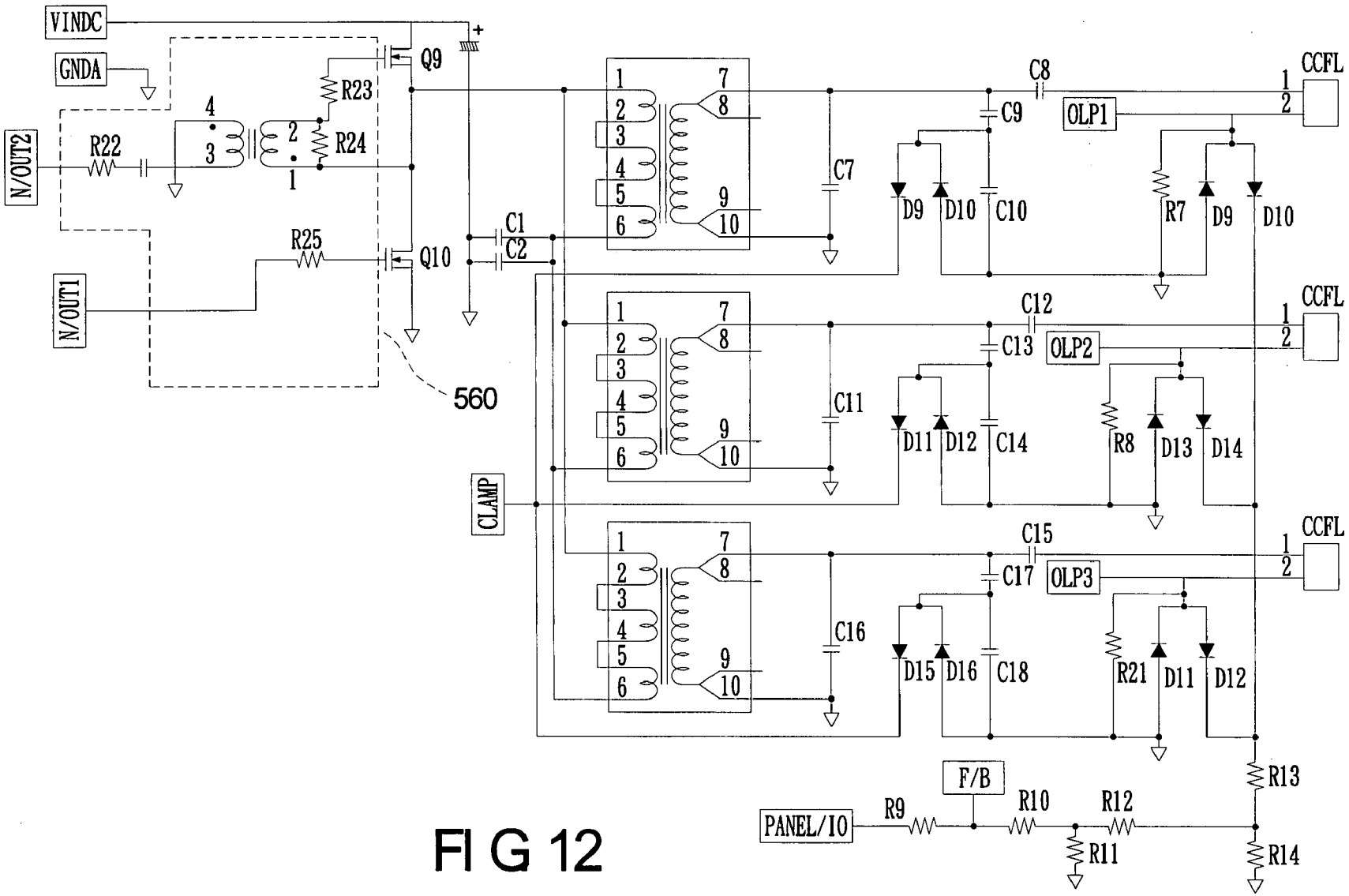
FIG. 12 is a circuit diagram of a half-bridge type inverter circuit.

Please refer to FIG. 12 as well as FIG. 8. In FIG. 12, the half-bridge type inverter circuit 56 is a dual-NMOS half-bridge type inverter circuit, and is connected to the two output signal pins (NOUT1, NOUT2) of the control IC 500 in FIG. 8 via a conversion circuit 560, and receives two control signals outputted by the two output signal pins (NOUT1, NOUT2). Moreover, the terminals F/B, CLAMP, and PORT shown in FIG. 12 are correspondingly connected to the feedback pin (F/B), the voltage acquisition pin (CLAMP), and the protection pin (PORT) of the control IC 500.

In the above illustrations, the modularized inverter control circuit of the present invention can be connected to the half-bridge type inverter circuit 56, send the two control signals to the conversion circuit 560 of the full-bridge type inverter circuit 56, and use the conversion circuit 560 to control switching actions of a power switch set Q9 and a power switch set Q10 for driving the lamps CCFL to be on.

Figure 13:
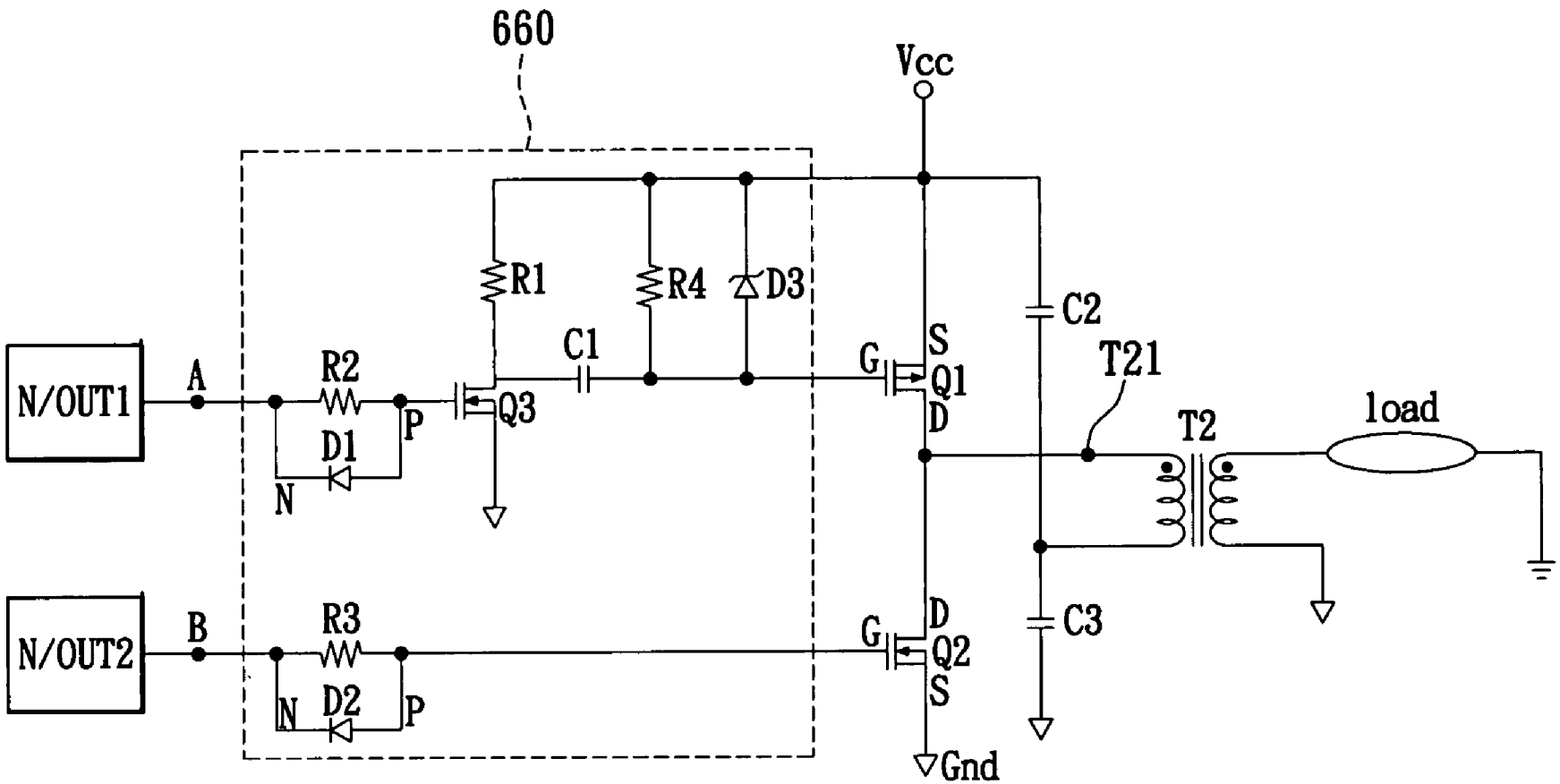
FIG. 13 is a circuit diagram of another half-bridge type inverter circuit.

Please refer to FIG. 13 as well as FIG. 8. In FIG. 12, the half-bridge type inverter circuit 56 is a 1N1P-MOS half-bridge type inverter circuit, and is connected to the two output signal pins (NOUT1, NOUT2) of the control IC 500 in FIG. 8 via a conversion circuit 660, and receives two control signals outputted by the two output signal pins (NOUT1, NOUT2).

Figure 14:
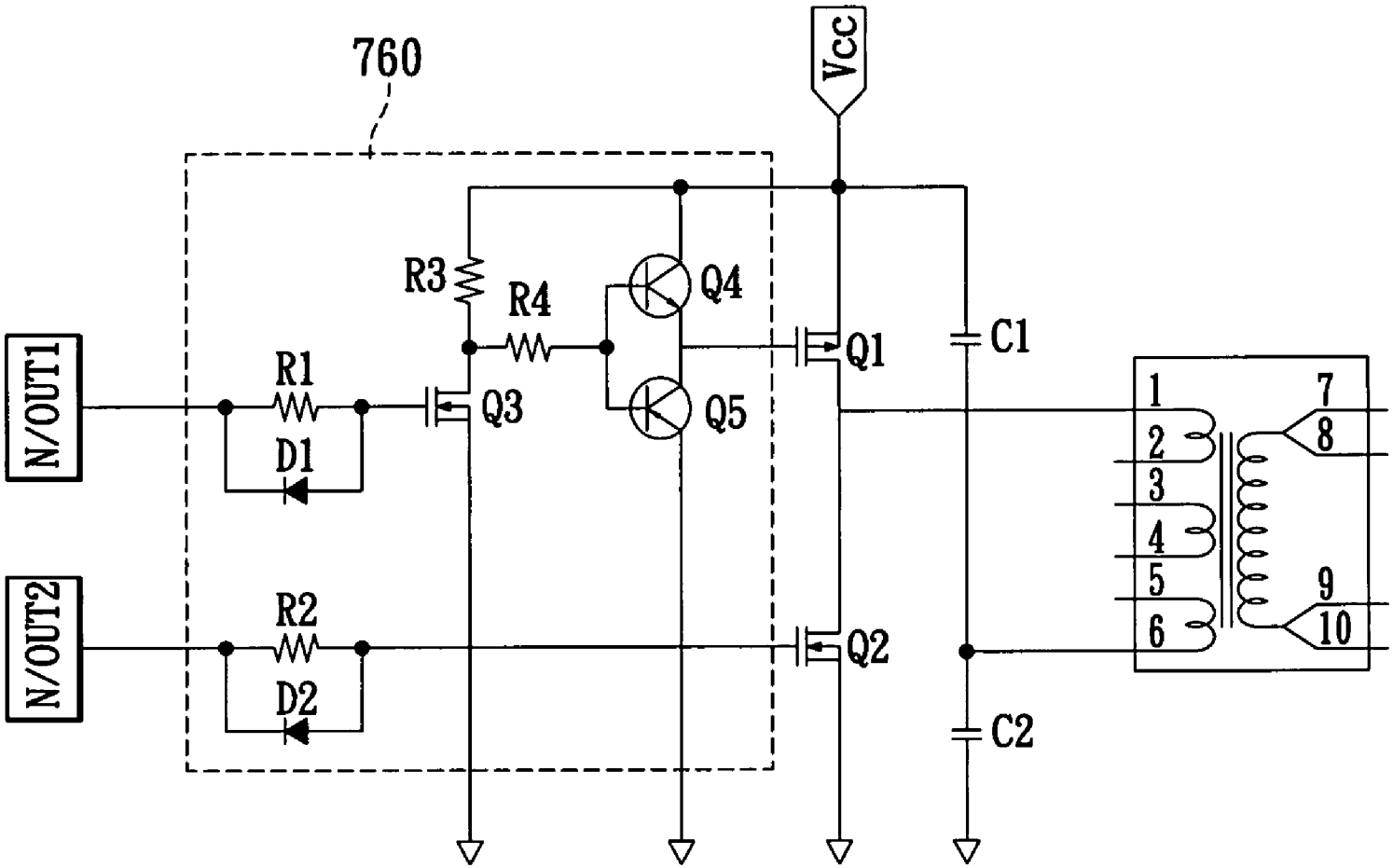
FIG. 14 is a circuit diagram of yet another half-bridge type inverter circuit.

Please refer to FIG. 14 as well as FIG. 8. In FIG. 14, the half-bridge type inverter circuit 56 is a 1N1P-MOS half-bridge type inverter circuit, and is connected to the two output signal pins (NOUT1, NOUT2) of the control IC 500 in FIG. 8 via a conversion circuit 760, and receives two control signals outputted by the two output signal pins (NOUT1, NOUT2).

Figure 15:
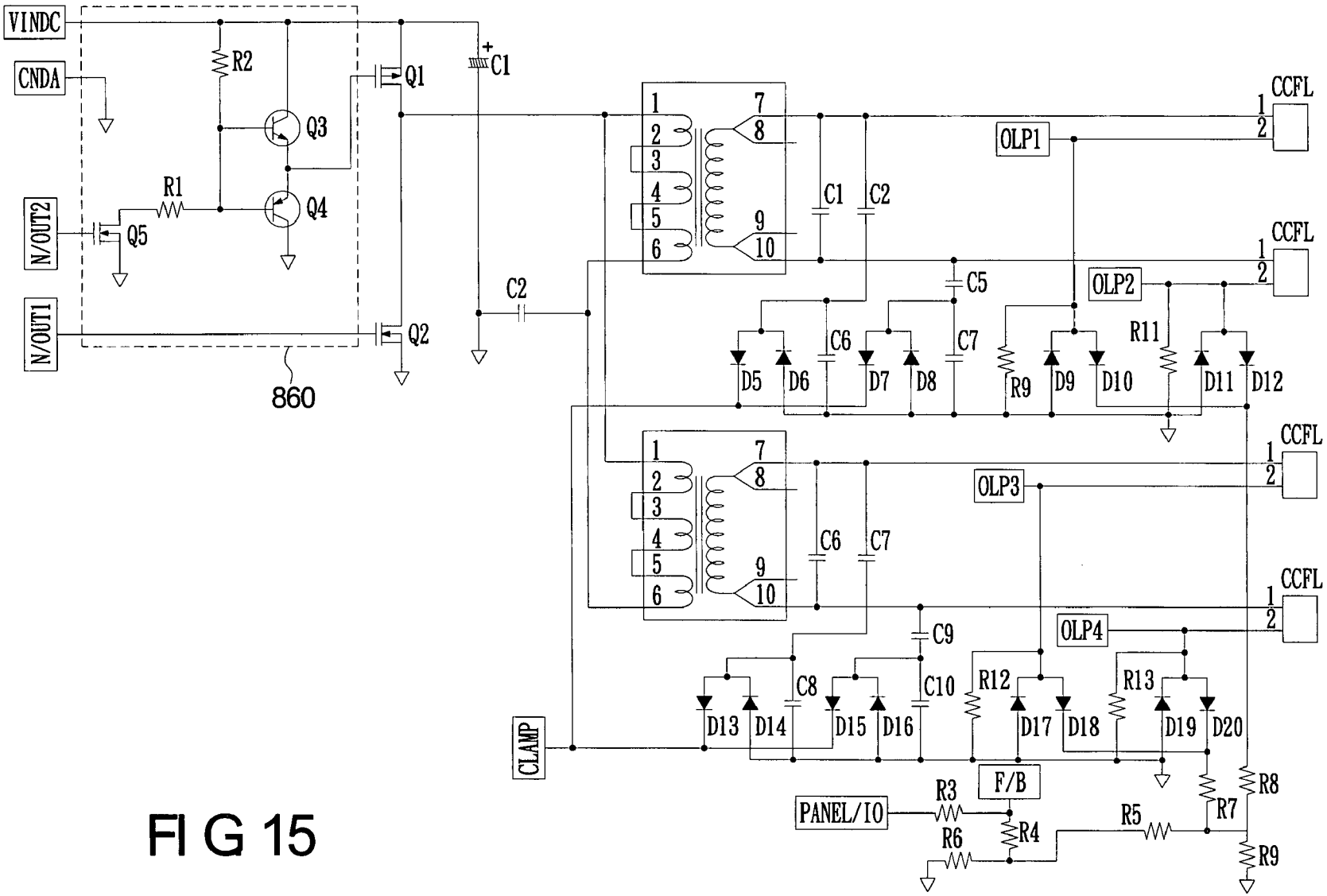
FIG. 15 is a circuit diagram of still yet another half-bridge type inverter circuit.

Please refer to FIG. 15 as well as FIG. 8. In FIG. 15, the half-bridge type inverter circuit 56 is a 1N1P-MOS half-bridge type inverter circuit, and is connected to the two output signal pins (NOUT1, NOUT2) of the control IC 500 in FIG. 8 via a conversion circuit 860, and receives two control signals outputted by the two output signal pins (NOUT1, NOUT2).

To sum up, the present invention mainly applies to control of an inverter circuit of a display backlight panel. The modularized inverter control circuit of the present invention can be flexibly matched with various inverter circuits of different topologies. The primary advantages are as follows.

1. Standardization and formularization can be accomplished to enhance the quality and reliability of product.

2. The development time of product like the time spent on debug and layout can be shortened.

3. The requirements of market can be met

4. Mass production can be accomplished to lower the cost.

5. Inverter circuits of different topologies like externally excited push-pull type, half-bridge type, and full-bridge type can be matched.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A modularized inverter control circuit packaged and disposed on a printed circuit board and used to connect and control an inverter circuit for driving actions of several lamps, said modularized inverter control circuit comprising:

a push-pull type control IC used to output two control signals via two output signal pins NOUT1 and NOUT2, the output signal pins NOUT1 and NOUT2 being coupled to any one of a push-pull inverter, a full-bridge inverter, and a half-bridge inverter;

a lamp current feedback unit connected to said control IC and said lamps and used to get working currents of said lamps and convert them into voltage forms sent to said control IC;

a turn-on voltage limit unit connected to said control IC and said lamps and used to get working voltages of said lamps and send them to said control IC;

a brightness adjustment control unit connected to said control IC and said lamps and used to adjust the brightness of said lamps;

a lamp protection unit connected to said control IC and said lamps and used for open-circuit and short-circuit protection of said lamps;

a power source control unit connected to said control IC and used to provide the required electric power for said control IC; and a reference unit connected to said control IC and composed of several resistors and capacitors and used to provide the required reference values for operation of said control IC.

2. The modularized inverter control circuit as claimed in claim 1, wherein said lamp current feedback unit is composed of a resistor and a capacitor.

3. The modularized inverter control circuit as claimed in claim 1, wherein said turn-on voltage limit unit is composed of a plurality of resistors and a plurality of capacitors.

4. The modularized inverter control circuit as claimed in claim 1, wherein said lamp protection unit is composed of a resistor, a capacitor, and a diode.

5. The modularized inverter control circuit as claimed in claim 1, wherein said power source control unit is composed of a resistor, a capacitor, a diode, and a transistor.

6. The modularized inverter control circuit as claimed in claim 1, wherein said lamp current feedback unit gets the working currents of said lamps via a feedback pin F/B.

7. The modularized inverter control circuit as claimed in claim 1, wherein said turn-on voltage limit unit gets the working voltages of said lamps via a voltage acquisition pin CLAMP.

8. The modularized inverter control circuit as claimed in claim 1, wherein said lamp protection unit gets open-circuit and short-circuit signals of said lamps via a protection pin PORT.

9. The modularized inverter control circuit as claimed in claim 1, wherein said power source control unit gets the required electric power for said control IC via a power source pin VCC, and gets a switch selection signal via a switch pin ON/OFF.

10. The modularized inverter control circuit as claimed in claim 1, further comprising a conversion circuit coupled between the output signal pins NOUT1 and NOUT2 and said full-bridge inverter, and said half-bridge inverter.

* * * * *